United States Patent [19]

Moen et al.

[11] Patent Number: 4,944,436

[45] Date of Patent: Jul. 31, 1990

[54] GARMENT HANGER COVER

[76] Inventors: Harold W. Moen; Darcy A. Moen, both of 74 Noonan Road, Regina, Saskatchewan, Canada, S4V OJ6

[21] Appl. No.: 312,037

[22] Filed: Feb. 17, 1989

[51] Int. Cl.[5] ..... A47G 25/20; A47G 25/14

[52] U.S. Cl. ..... 223/98; 223/87

[58] Field of Search ..... 223/87, 98

[56] References Cited

U.S. PATENT DOCUMENTS

| | | | |
|---|---|---|---|
| 2,292,786 | 8/1942 | Hobelman | 223/98 |
| 2,866,583 | 12/1958 | Batts | 223/98 |
| 3,033,430 | 5/1962 | Zintel | 223/98 |
| 3,177,706 | 1/1964 | Kestner | 223/98 |
| 3,294,296 | 12/1966 | Gelman | 223/98 |
| 3,665,518 | 5/1972 | Leadford | 2/87 |

*Primary Examiner*—Werner H. Schroeder
*Assistant Examiner*—Bibhu Mohanty

[57] ABSTRACT

A garment hanger cover in the form of a blank having fold lines, cuts forming cooperating assembly tongues and lip openings, and cuts forming slits to receive accessories such as belts and ties. The cover is flat for packaging but lends itself well to expeditious assembly since nothing additional is required to form it into a broad stable support easily mounted on a conventional hanger for crease and wrinkle free storage.

5 Claims, 2 Drawing Sheets

GARMENT HANGER COVER

BACKGROUND OF INVENTION

The present invention relates generally to garment hanger covers and in particular to covers formed of flexible cardboard or the like for use with wire garment hangers. The knownprior art in particular U.S. Pats. 3,428,229, 3,294,296, 2,841,316, 2,135,277 and Canadian Patent Nos. 831 854 and 601 950 has provided some measure of support for a garment when placed on a hanger. Such support is required to prevent any possibility of creasing or wrinkling thereby loosing the freshly pressed appearance of the garment. The majority of the present hanger covers require a considerable amount of material, are complicated, expensive, require considerable assembly time and do not provide the unique features as presented herein in applicant's device.

SUMMARY OF INVENTION

The present invention, in order to overcome these deficiencies, has as its main object to provide a hanger cover blank which is to be folded on fold lines, which when folded has integral tongue and lip securing means and which provides securing means for accessories such as belts and ties which often become misplaced with great inconvenience and expense. The integral tongue obviates the use of fastening means such as staples. The formed cover with its broad rounded support is then ready to be slipped onto a conventional hanger to receive a garment plus accessories.

A further object is the provision of a hanger cover which when placed over a conventional wire hanger will fully support various types of garments in a firm and crease free manner.

It is a further object of the present invention to provide an economical and easily manufactured simple blank which is comprised only of a flat body, with parallel sides, curved end edges, fold lines, and simple cuts.

It is a further object of the present invention to provide a hanger cover blank that can be easily shipped, stored and assembled with a minimum of time and effort.

Other objects and a further understanding of the invention may be had by referring to the following description and claims, taken in conjunction with the accompanying drawings in which:

PREFERRED EMBODIMENT

Figure 1:
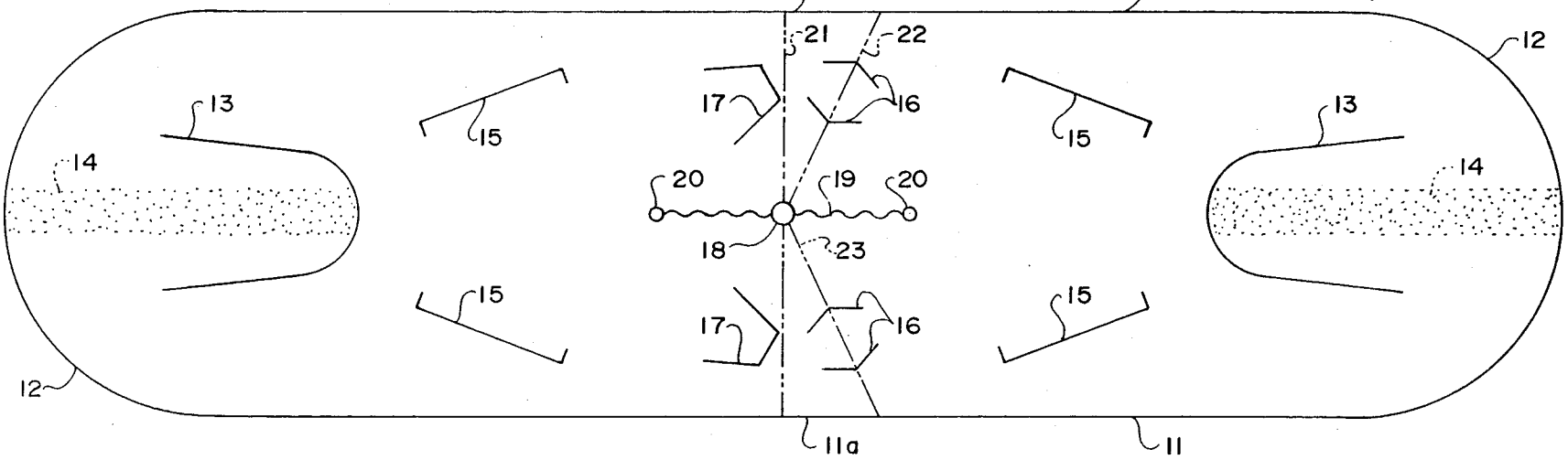
FIG. 1 is a plan view of the flat hanger blank with its cuts, openings and fold lines.

Referring now to the drawings, there is shown in FIG. 1 a hanger cover blank generally designated by the numeral 10 whose outer perimeter is formed by generally parallel side edges 11 joined by curved end edges 12. A central opening 18 formed at the joining of the central longitudinal and transverse axis provides an entrance for a conventional hanger 4 including a hook 5 which will pass through the opening 18, downwardly diverging arms 7 and 8 extending from the hook to support the formed cover and a cross bar 6 to keep the arms spread apart. An undulating cut 19 extends from the central opening 18 along a portion of the longitudinal axis to allow ease of penetration of the hanger hook 5 the undulations preventing movement of the cover relative to the hanger along this axis. At the ends of the undulating cut 19 are small circular openings 20 to prevent a tearing or extension of the cut 19.

Figure 2:
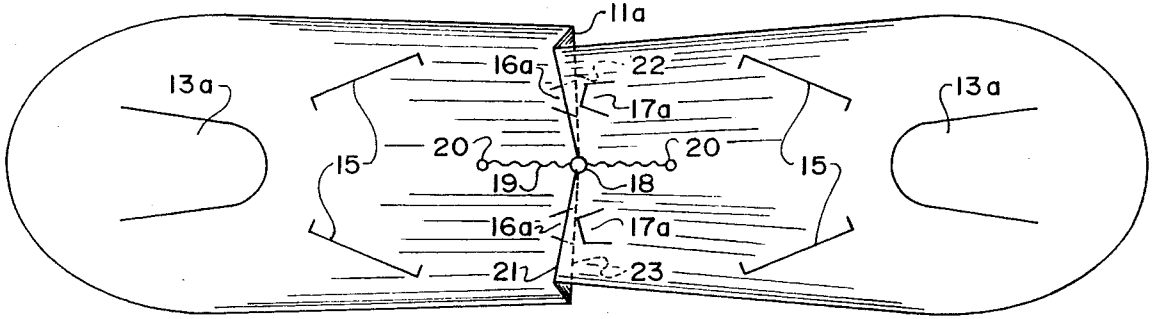
FIG. 2 is a partially folded bottom view.
Figure 3:
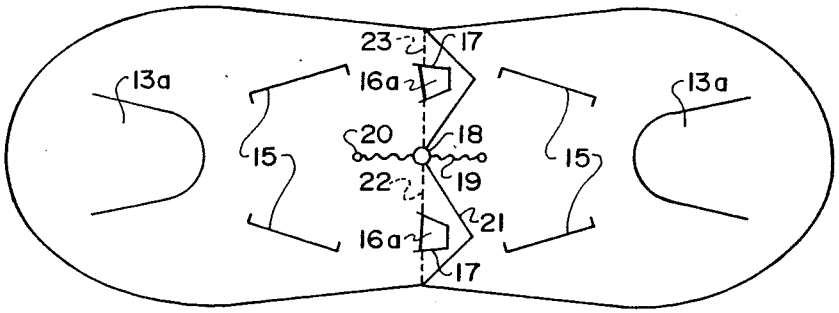
FIG. 3 is a fully assembled and locked bottom view.

Three fold lines are formed, line 21 which can be perforated is along the central transverse axis passing through opening 18 thus dividing the blank into two equal end portions, and lines 22 and 23 which can be scored originating at opening 18 each extending outwardly therefrom to the sides 11 diverging from fold line 21 to form an angle with line 21 both in the same end portion with the angle being such as to form rounded support surfaces for the garment when the cover is folded along these lines in the manner shown in FIG. 2 and FIG. 3. The fold lines basically form triangles, the third sides of which, are formed by 11*a*, a portion of sides 11.

Two pairs of cuts 16 are made generally transverse to fold lines 22 and 23 at such an angle that they become tapered locking tongues or tabs 16*a* when the blank is folded. Two cuts 17 on the opposite end portion of the blank form lips 17*a* which when displaced provide an opening for easy insertion of the locking tongue 16*a* thereby securing the folded form in its desired shape. The tongues 16*a* when forced to the underside through the opening provided by displaced lip 17*a* are then covered by the lip to give a neat and smooth surface next to the garment.

Several cut lines 15 forming slits, slots or passages can be made in both end portions of the blank 10, these are formed at such an angle as to present a level cut when the cover blank is in its formed configuration. These cuts 15 provide, by a slight deformation of the material at the cut, convenient securing means for a belt, tie or the like which when lost generates unlimited grief for the store owner and customer.

Two further cuts 13 one in each end portion near the outer extremities of the longitudinal axis each provide a strap retainer 13*a* which prevent garments especially a dress supported by straps from sliding off the hanger cover 10 when formed and mounted on a hanger 4.

At the outer ends along the longitudinal axis on the top or outer portion is a slip resistant material 14 to further aid in firmly holding a garment to prevent the undesirable crease or wrinkle.

Now turning to FIG. 2, the underside of the blank 10 has been shown with the blank partially folded. The fold has been made along fold line 21, 22 and 23 with line 11*a* folding back upon its own end portion. The tongues 16*a* have moved closer to lips 17*a* and are approaching the same plane.

In FIG. 3 the fold has been completed and the tongues 16*a* have been forced through an opening, to the underside of the hanger cover, provided by moving lip 17*a*. The lip 17*a* is now brought to the topside to give a smoother finished surface for a garment.

Figure 4:
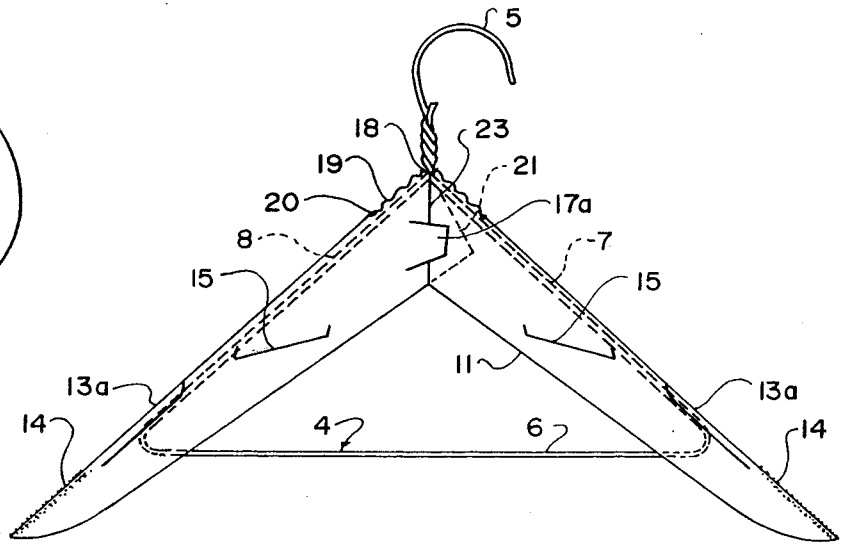
FIG. 4 is a from elevation with assembled blank mounted on a conventional wire hanger.

FIG. 4 shows the cover blank 10 folded and locked by tongues 16*a* which are on the inside and are covered by lips 17*a*. The hook 5 of hanger 4 has been forced up through cut 19 and remains exposed by occupying opening 18. The two arms 7 and 8 of hanger 4 support the cover in the final position ready for use. The accessory slits 15 in a basically level position ready for use and the strap retainers 13*a* can be positioned outwardly if necessary to engage the straps of a garment so equipped.

It will be seen from the above description that the objects set out heretofore will be fully met by the instant invention.

Although the invention has been described with a certain degree of particularity, it is understood that the present disclosure has been made only by way of example and that numerous changes in the details of construction may be resorted to without departing from the spirit and scope of the invention as hereinafter claimed.

The embodiments of the invention in which an exclusive property of privilege is claimed is defined as follows:

1. A cover for a garment hanger of the type having a pair of diverging arms and an integral hook supporting such arms comprising, a fold formed generally rectangular normally flat flexible sheet of material having a central opening therein capable of permitting the passage of said hook therethrough, a main fold line on the central transverses axis dividing the sheet into opposite end portions, two further fold lines in one of said end portions, wedge shaped locking tongues formed by cuts generally transverse to and crossing the further fold lines, lips formed by a cut on the portion opposite to the one containing the locking tongues, which when pivotally displaced permit entry and provide coverage of the locking tongues in a unique and expeditious manner, such easily formed and positively locked cover providing a complete support for a garment on said hanger.

2. A cover as claimed in claim 1 further comprising an undulating cut extending in opposite directions longitudinally from the central opening and terminating a short distance therefrom in two anti-tear apertures.

3. A method of making a cover blank for a hanger having a pair of diverging arms and a hook supporting said arms, comprising, providing a generally rectangular blank of flexible sheet material, making a central opening therein adapted to permit passage of said hanger hook, providing a main fold line along the central transverse axis of the blank dividing the blank into two end portions, providing two further fold lines in one of the end portions, making slits on both said further fold lines generally transverse thereto enabling the formation of wedge shaped tongues, making slits in the other end portion enabling the formation of covering lips, whereby upon a single simultaneous folding on all the fold lines the tongues may enter the openings provided when the covering lips are pivotally displaced thereby enabling the formation of a cover with broad supporting surfaces in a most expeditious manner.

4. The method of claim 3 further comprising making two undulating cuts extending both ways along the central longitudinal axis from the central opening and terminating in anti-tear apertures.

5. The method of claim 3 wherein the slits or slots are formed by a die cutting process.

* * * * *